US009243858B1

(12) United States Patent
Stiles

(10) Patent No.: US 9,243,858 B1
(45) Date of Patent: Jan. 26, 2016

(54) COVER ASSEMBLY FOR A TRIGGER GUARD

(71) Applicant: Ricky Dale Stiles, Shawnee, OK (US)

(72) Inventor: Ricky Dale Stiles, Shawnee, OK (US)

( * ) Notice: Subject to any disclaimer, the term of this patent is extended or adjusted under 35 U.S.C. 154(b) by 0 days.

(21) Appl. No.: 14/444,754

(22) Filed: Jul. 28, 2014

(51) Int. Cl.
*F41A 17/06* (2006.01)
*F41A 17/46* (2006.01)

(52) U.S. Cl.
CPC ..... *F41A 17/066* (2013.01); *F41A 17/46* (2013.01)

(58) Field of Classification Search
CPC ..... F41A 17/46; F41A 17/066; F41A 17/063; F41A 17/02; F41A 17/06
See application file for complete search history.

(56) References Cited

U.S. PATENT DOCUMENTS

| | | | | |
|---|---|---|---|---|
| 5,024,017 | A | 6/1991 | Nishioka | |
| 5,449,103 | A | 9/1995 | Tilley | |
| 5,561,935 | A | 10/1996 | McCarthy et al. | |
| 5,812,252 | A | 9/1998 | Bowker et al. | |
| 5,960,575 | A | 10/1999 | Chiovitt et al. | |
| 6,253,480 | B1 | 7/2001 | Florez | |
| 6,260,300 | B1 | 7/2001 | Klebes et al. | |
| 6,874,265 | B1 * | 4/2005 | Pathak | F41A 17/54 42/70.06 |
| 8,186,088 | B2 | 5/2012 | Victor et al. | |
| 8,347,539 | B2 | 1/2013 | Burns, III | |
| 9,097,479 | B1 * | 8/2015 | Barido | F41A 17/54 |
| 2011/0047849 | A1 | 3/2011 | Brenner | |
| 2012/0291327 | A1 | 11/2012 | Boutot, Jr. | |
| 2013/0312306 | A1 | 11/2013 | Ruffin | |
| 2013/0318847 | A1 * | 12/2013 | Kelly | F41A 17/46 42/70.06 |

* cited by examiner

*Primary Examiner* — Joshua Freeman
*Assistant Examiner* — Bridget Cochran
(74) *Attorney, Agent, or Firm* — Dunlap Codding, P.C.

(57) ABSTRACT

A cover assembly for a trigger guard is described having a housing, a catch member connected to the housing, a release assembly mounted to the housing, and a biometric sensor assembly at least partially mounted to the housing. The housing has a base, a first sidewall and a second sidewall extending upwardly from the base to define a trigger guard receiving space. At least the first sidewall has an opening extending therethrough. The catch member is moveable between a locked position and an unlocked position. The release assembly is operable to cause the catch member to move from the locked position to the unlocked position. The biometric sensor assembly is configured to validate a biometric input and cause the release assembly to move the catch member from the locked position to the unlocked position based on validation of the biometric input.

18 Claims, 4 Drawing Sheets

COVER ASSEMBLY FOR A TRIGGER GUARD

BACKGROUND OF THE INVENTION

Numerous ways have been attempted for securing firearms against unauthorized use. One such way has been to securing a cover assembly over the trigger guard to block access to the trigger of the fire arm.

Some trigger guard covers are formed of multiple discrete pieces covering either side of the trigger guard with an element extending between the pieces to secure the cover over the trigger guard. Multiple piece trigger guard covers with an exposed seam present inherent structural and security weak points. Covers having a single piece construction are also known, but fail to provide a secure cover for the trigger Regardless of construction, multi-piece or single piece, trigger guard covers generally cannot be removed from the trigger guard with one-handed operation. Further current trigger guard covers are not generally removable by authorized users while the firearm hosting the trigger guard cover is in a firing or ready position.

A need exists for a trigger guard cover that can be removed by one-handed operation in a firing position. Further, there is a need for a trigger guard cover which enables an authorized user to access the firearm while preventing unauthorized access without adding substantial weight or bulk to the firearm hosting the trigger guard cover.

SUMMARY OF THE INVENTIVE CONCEPTS

This summary is provided to introduce a selection of concepts that are further described in the detailed description. This summary is not intended to identify key or essential features of the claimed subject matter, nor is it intended to be used as an aid in limiting the scope of the claimed subject matter.

In one embodiment, a cover assembly for a trigger guard is described as having a housing, a catch member mounted to the housing, a release assembly mounted to the housing, and a biometric sensor assembly at least partially mounted to the housing. The housing has a base, a first sidewall extending upwardly from the base, and a second sidewall extending upwardly from the base in a spaced relationship to the first sidewall so that the base, the first sidewall, and the second sidewall cooperate to define a trigger guard receiving space. At least the first sidewall having an opening extending therethrough. The catch member extends from the first sidewall so as to be moveable between a locked position and an unlocked position. In the locked position at least a portion of the catch member extends through the opening of the first sidewall and into the trigger guard receiving space in a way to engage a trigger guard received in the trigger guard receiving space and thereby secure the housing over the trigger guard. In the unlocked position the catch member is retracted from the trigger guard receiving space to allow the housing to be removed from the trigger guard. The release assembly is operable to cause the catch member to move from the locked position to the unlocked position. The biometric sensor assembly is configured to validate a biometric input and cause the release assembly to move the catch member from the locked position to the unlocked position based on validation of the biometric input.

In another version, a cover assembly for a trigger guard is described as having an inner housing, a catch member extending from the inner housing, a release assembly mounted to the inner housing, a biometric sensor assembly at least partially mounted to the inner housing, and an outer housing configured to encompass the inner housing, the catch member, the release assembly, and at least a portion of the biometric sensor assembly. The inner housing has a base, a first sidewall extending upwardly from the base, and a second sidewall extending upwardly from the base in a spaced relationship to the first sidewall so that the base, the first sidewall, and the second sidewall cooperate to define a trigger guard receiving space. At least the first sidewall having an opening extending therethrough. The catch member extends from the first sidewall so as to be moveable between a locked position and an unlocked position. In the locked position at least a portion of the catch member extends through the opening of the first sidewall and into the trigger guard receiving space in a way to engage a trigger guard received in the trigger guard receiving space and thereby secure the housing over the trigger guard. In the unlocked position the catch member is retracted from the trigger guard receiving space to allow the housing to be removed from the trigger guard. The release assembly is operable to cause the catch member to move from the locked position to the unlocked position. The biometric sensor assembly is configured to validate a biometric input and cause the release assembly to move the catch member from the locked position to the unlocked position based on validation of the biometric input.

In another embodiment, a cover for a trigger guard assembly is described as having an inner housing, a catch member extending from the inner housing, a release assembly mounted to the inner housing, a biometric sensor assembly at least partially mounted to the inner housing, a power source connection mounted to the inner housing, and an outer housing connected to the inner housing. The inner housing forms a rigid single member and has a base, a first sidewall extending upwardly from the base, and a second sidewall extending upwardly from the base in a spaced relationship to the first sidewall so that the base, the first sidewall, and the second sidewall cooperate to define a trigger guard receiving space. At least the first sidewall having an opening extending therethrough. The catch member has a retaining arm and a catch. The catch member extends from the first sidewall and is moveable between a locked position and an unlocked position. In the locked position, the catch extends through the opening of the first sidewall and into the trigger guard receiving space in a way to engage a trigger guard received in the trigger guard receiving space and thereby secure the inner housing over the trigger guard. In the unlocked position, the catch is retracted from the trigger guard receiving space to allow the inner housing to be removed from the trigger guard. The release assembly is operable to cause the catch member to move from the locked position to the unlocked position. The biometric sensor assembly is configured to validate a biometric input and cause the release assembly to move the catch member from the locked position to the unlocked position based on validation of the biometric input. The power source connection is operatively connected to at least one of the release assembly and the biometric sensor assembly such that a power source connected to the power source connection provides power to the release assembly and the biometric sensor assembly. The outer housing is configured to encompass the inner housing, the catch member, the release assembly, and at least a portion of the biometric sensor assembly. The outer housing defines a first opening for access to the biometric sensor assembly and a second opening for access to the power source connection.

BRIEF DESCRIPTION OF THE DRAWINGS

Certain embodiments of the inventive concepts will hereafter be described with reference to the accompanying drawings, wherein like reference numerals denote like elements. It should be understood; however, that the accompanying figures illustrate the various implementations described herein and are not meant to limit the scope of the various technologies described herein.

DETAILED DESCRIPTION OF EXEMPLARY EMBODIMENTS

Specific embodiments of the inventive concepts disclosed herein will now be described in detail with reference to the accompanying drawings. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited or inherently present therein.

As used herein any references to "one embodiment," "an embodiment," or "some embodiments" means that a particular element, feature, structure, or characteristic described in connection with the embodiment is included in at least one embodiment. The appearances of the phrase "in one embodiment" in various places in the specification may not refer to the same embodiment.

Figure 1:
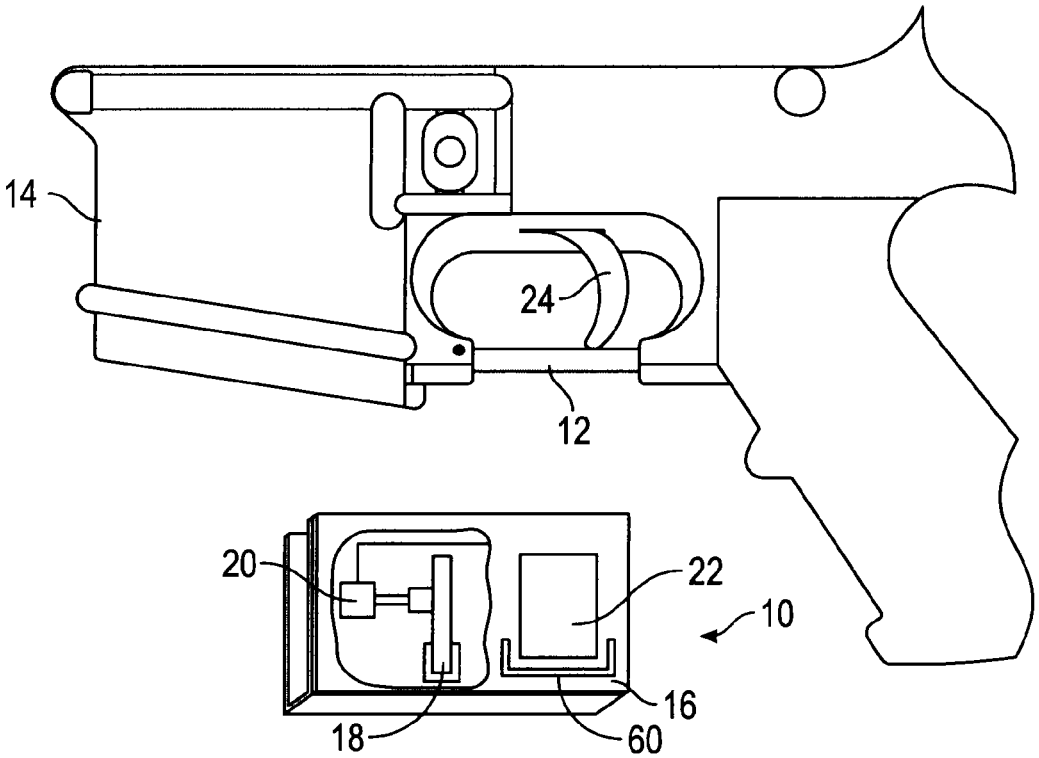
FIG. 1 is a perspective view of a firearm and partially cutaway, perspective view of a cover assembly constructed in accordance with the inventive concepts disclosed herein.

Referring now to the drawings, and in particular FIG. 1, a cover assembly 10 for a trigger guard constructed in accordance with the inventive concepts disclosed herein is shown in conjunction with a firearm 14 having a trigger guard 12. The cover assembly 10 may include a housing 16, a catch member 18 extending from the housing 16, a release assembly 20 mounted to the housing 16, and a biometric sensor assembly 22 at least partially mounted to the housing 16. The cover assembly 10 may be sized and dimensioned such that the housing 16 forms one or more point of contact with the firearm 14 in addition to a point of contact between the catch member 18 and the trigger guard 12. The at least two points of contact, at the housing 16 and the catch member 18, may cause the cover assembly 10 to be secured to the firearm 14 to prevent removal of the cover assembly 10 and activation of a trigger 24 within the trigger guard 12.

Figure 2:
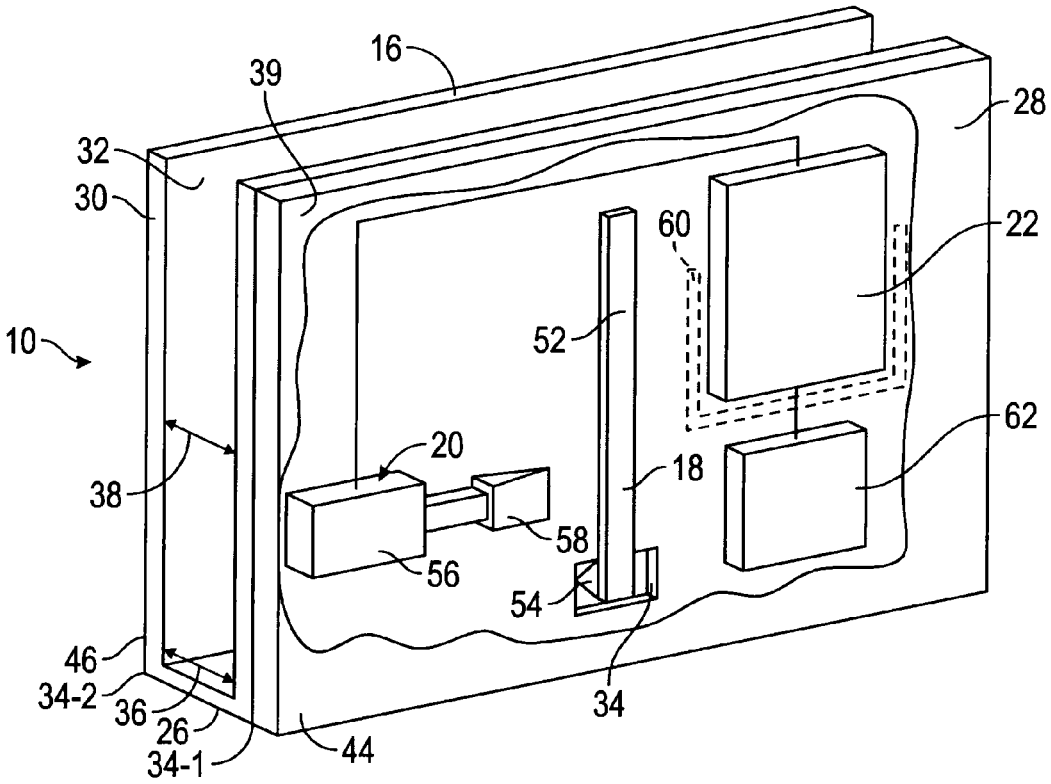
FIG. 2 is a partially cutaway, perspective view of the cover assembly of FIG. 1.
Figure 3A:
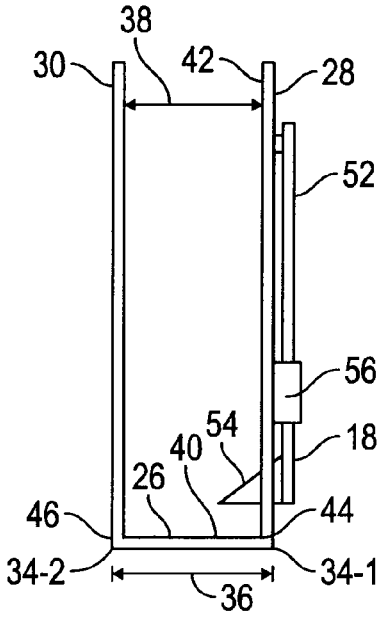
FIG. 3A is an end elevational view of the cover assembly of FIG. 1 shown in a locked position with the cover plate removed.

Referring now to FIGS. 2 and 3, the housing 16 has a base 26, a first sidewall 28 extending upwardly from the base 26, and a second sidewall 30 extending upwardly from the base 26 in a spaced relationship to the first sidewall 28. The first sidewall 28 and the second sidewall 30 cooperate to define a trigger guard receiving space 32. For example, the first sidewall 28 may extend upwardly from a first edge 34-1 of the base 26 and the second sidewall 30 may extend upwardly from a second edge 34-2 such that a width 36 of the base 26 extending between the first and second edges 34-1 and 34-2 corresponds to a width 38 of the trigger guard receiving space 32. At least the first sidewall 28 has an opening 34 extending therethrough. In some embodiments, the housing 16 may include a cover plate 39 to prevent access to the catch member 18, the release assembly 20, and at least a portion of the biometric sensor assembly 22.

In some embodiments, the base 26, the first sidewall 28, and the second sidewall 30 may form the housing 16 as a single piece unit, thereby forming a rigid single member. For example, the base 26, the first sidewall 28, and the second sidewall 30 may be formed from a single piece of metal, plastic, or other suitable material contoured to form the housing 16 and the trigger guard receiving space 32. In these embodiments, the base 26, the first sidewall 28, and the second sidewall 30 may be formed from a material by bending the material, moulding a flat piece of material, injection moulding the material, extrusion, machining, 3D printing, or any other suitable method of manufacture to form the housing 16 from a single piece of material.

In other embodiments, the base 26, the first sidewall 28, and the second sidewall 30 may be formed as discrete pieces of material and connected together to form the housing 16. For example, the base 26, the first sidewall 28, and the second sidewall 30 may each be formed from discrete pieces of metal, plastic, or other suitable material, where the first sidewall 28 has a first edge 44 connected to first edge 34-1 of the base 26 and the second sidewall 30 has a first edge 46 connected to second edge 34-2 of the base 26. In these embodiments, the base 26, the first sidewall 28, and the second sidewall 30 may be connected together by adhesives, brazing, welding, fasteners, or any other suitable connection mechanism.

The trigger guard receiving space 32 is sized and dimensioned to receive the trigger guard 12. The trigger guard receiving space 32 may be defined on one end by the base 26, forming a closed end 40 of the trigger guard receiving space 32 and an open end 42 opposite the closed end 40. The open end 42, extending between the first sidewall 28 and the second sidewall 30 may be sized and dimensioned to receive the trigger guard 12 and allow the trigger guard 12 to pass from the open end 42 toward the closed end 40 of the trigger guard receiving space 32.

In some embodiments, as noted above, the trigger guard receiving space 32 may have the width 38 corresponding to the width 36 of the base 26. In some embodiments, as shown, the width 38 of the trigger guard receiving space 32 may maintain a constant width as the trigger guard receiving space 32 extends from the base 26 toward the open end 42 trigger guard receiving space 32. However, in some embodiments, the width 38 of the trigger guard receiving space 32 may vary to conform to the trigger guard 12 of the firearm 14.

Figure 4:
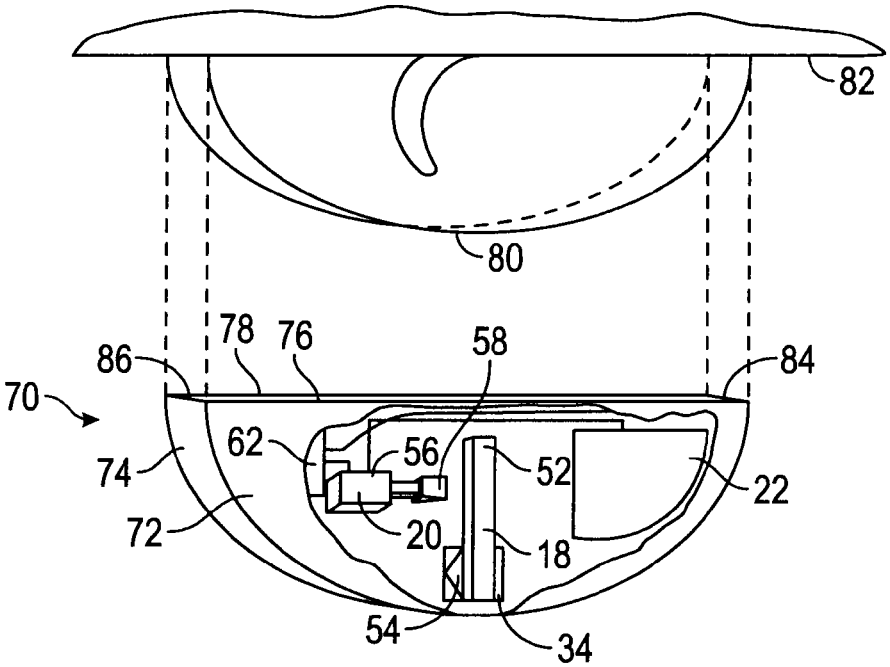
FIG. 4 is a partially cutaway, perspective view of another embodiment of a cover assembly in accordance with the inventive concepts disclosed herein.
Figure 5:
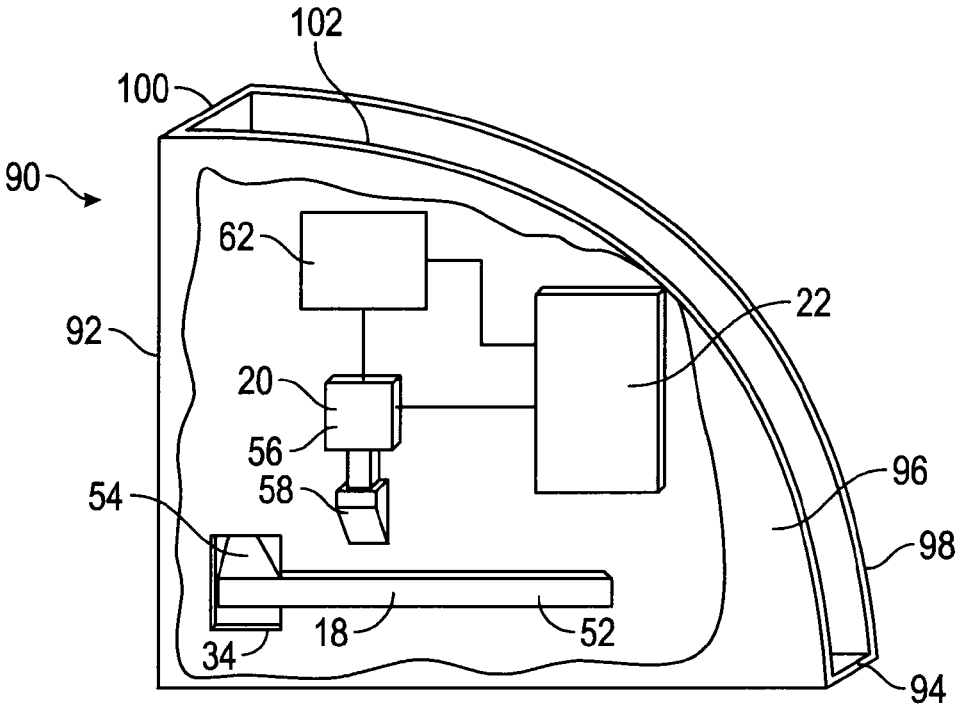
FIG. 5 is a partially cutaway, perspective view of another embodiment of a cover assembly in accordance with the inventive concepts disclosed herein.

In some embodiments, the trigger guard receiving space 32 may be sized and dimensioned to receive the trigger guard 12 of one or more firearms, or triggered weapons, of differing makes, models, manufacture, and type. As will be explained in more detail below, in some embodiments, the trigger guard receiving space 32 may be sized to receive the trigger guard 12 of a plurality of differing rifles and shotguns, as shown in FIG. 4. In other embodiments, the trigger guard receiving space 32 may be configured to receive the trigger guard 12 of a plurality of differing handguns, as shown in FIG. 5. However, in some embodiments, the trigger guard receiving space 32 may be configured to receive the trigger guard 12 of a specific make, model, manufacture, or type of firearm, such that the cover assembly 10 is designed to fit a single make, model, manufacture, or type of firearm.

The opening 34 may be defined within the first sidewall 28 and extend therethrough such that a portion of the catch member 18 may extend into the trigger guard receiving space 32 to contact the trigger guard 12, as will be discussed in more detail below. The opening 34 may be sized and positioned to prevent over penetration of the catch member 18 into the trigger guard receiving space 32.

Figure 3B:
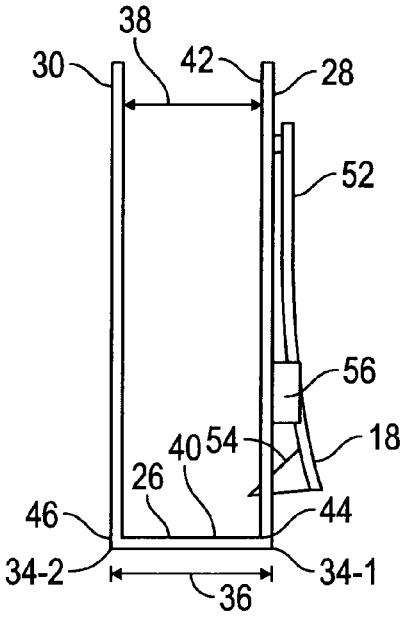
FIG. 3B is an end elevational view of the cover assembly of FIG. 1 shown in an unlocked position with the cover plate removed.

The catch member 18 may extend from the first sidewall 28 so as to be moveable between a locked position (FIG. 3A) and an unlocked position (FIG. 3B). In the locked position, at least a portion of the catch member 18 extends through the opening of the first sidewall 28 and into the trigger guard receiving space 32 in a way to engage the trigger guard 12 received in the trigger guard receiving space 32 and thereby secure the housing 16 over the trigger guard 12. In the unlocked position, the catch member 18 may be retracted from the trigger guard receiving space 32 to allow the housing 16 to be removed from the trigger guard 12. In at least some embodiments, the catch member 18 may be biased to the locked position.

As shown in FIGS. 2 and 3, the catch member 18 may include a retaining arm 52 and a catch 54. In some embodiments, the retaining arm 52 may be a spring and the catch 54 may extend outwardly from the retaining arm 52 through the opening 34 of the first sidewall 28 and into the trigger guard receiving space 32. Where implemented as a spring, the retaining arm 52 may have a substantially flat, conical, rectangular, circular, or other suitable shape, such that the retaining arm 52 may be moved between the locked position and the unlocked position. As noted above, the catch member 18 may be biased to the locked position. In these embodiments, the retaining arm 52 may cause the catch 54 to remain within the opening 34 until moved by the release assembly 20.

The release assembly 20, mounted to the housing 16, may be operable to cause the catch member 18 to move from the locked position to the unlocked position. In some embodiments, the release assembly 20 may include an actuator 56 and a wedge member 58 connected to the actuator 56. The actuator 56 may be configured to move the wedge member 58 to contact the retaining arm 52. After the wedge member 58 contacts the retaining arm 52, at a predetermined position, the wedge member 58 may cause the retaining arm 52 to move to a point positioning the catch 54 out of contact with the trigger guard 12, thereby enabling the cover assembly 10 to be removed from around the trigger guard 12.

The biometric sensor assembly 22, at least partially mounted to the housing 16, may be configured to validate a biometric input and cause the release assembly 20 to move the catch 54 from the locked position (FIG. 3A) to the unlocked position (FIG. 3B) based on validation of the biometric input. The biometric sensor assembly 22 may be a fingerprint reader, a voice recognition assembly, an iris scanning assembly, a retinal scanning assembly, a hand geometry recognition assembly, a vein identification assembly, or any other suitable assembly or apparatus capable of validating identity based on one or more biometric measurements. The biometric input may be a fingerprint, an iris pattern, a retinal pattern, a hand geometry pattern, a vein pattern, or other suitable biometric identification pattern capable of being interpreted and used to validate an identity of a user by the biometric sensor assembly 22.

In some embodiments, the biometric sensor assembly 22 may define a ridge 60, shown in FIG. 1, extending outwardly from the biometric sensor assembly 22. The ridge 60 may be configured to enable removal of the housing 16 from the trigger guard 12 upon validation of the biometric input. The ridge 60 may be formed integral to the housing 16 or may be formed separately and connected thereto. The ridge 60 may be formed from metal, plastic, or any other suitable material and may be formed by extrusion, moulding, machining, 3D printing, or any other suitable method of manufacturing.

The cover assembly 10 may further include a power source connection 62 connected to the housing 16. The power source connection 62 may be a bay sized and dimensioned to receive a battery or other power source. The power source connection 62 may be electrically connected to the biometric sensor assembly 22 such that power supplied by the power source in contact with the power source connection 62 may be directed through the power source connection 62 to the biometric sensor assembly 22. The power from the power source may thereby enable the biometric sensor assembly 22 to validate identity based on the one or more biometric measurements. The power source connection 62 may additionally be connected to the release assembly 20 so as to provide power from the power source in contact with the power source connection 62 to the release assembly 20 to enable operation of the release assembly 20. In some embodiments, the power source connection 62 may be directly electrically connected to the release assembly 20, while in other embodiments, the power source connection 62 may be electrically connected to the release assembly through the biometric sensor assembly 22 such that power passes from the power source connection 62, through the biometric sensor assembly 22 to the release assembly 20.

Although shown as a single power source connection 62, it will be understood by one skilled in the art that the power source connection 62 could be a plurality of power source connections, each of which attached to a different structure, requiring power for operation, within the cover assembly 10. For example, a first power source connection may be mounted to the housing 16 and connected to the release assembly 20 and a second power source connection may be mounted to the housing 16 and connected to the biometric sensor assembly 22.

Referring now to FIG. 4, therein shown is another embodiment of a cover assembly 70 in accordance with some embodiments of the present disclosure. The cover assembly 70 may be implemented similarly to the cover assembly 10, with the catch member 18, the release assembly 20, the biometric sensor assembly 22, and the power source connector 62. However, the cover assembly 70 may include a housing 72 having a base 74 having a substantially curved shape, a first sidewall 76 extending outwardly from a portion of the base 74 and within the curve of the base 74, and a second sidewall 78 extending outwardly from a portion of the base 74 and within the curve of the base 74. The curve of the base 74 may be sized and dimensioned to substantially conform to a trigger guard 80 of a firearm 82. The curve of the base 74 may additionally be sized and dimensioned to contact the firearm 82 at, at least, one of a first end 84 and a second end 86 of the base 74. The first end 84 and the second end 86 may act as a first and second point of contact between the cover assembly 70 and the firearm 82 such that when the trigger guard 80 passes the catch member 18, the catch member 18, the first end 84, and the second end 86 form three points of contact between the cover assembly 70 and the firearm 82 to thereby secure the housing 72 over the trigger guard 80.

Referring now to FIG. 5, therein shown is another embodiment of a cover assembly 90 in accordance with some embodiments of the present disclosure. The cover assembly 90 may be implemented similarly to the cover assembly 10, with the catch member 18, the release assembly 20, the biometric sensor assembly 22, and the power source connector 62. However, the cover assembly 90 may include housing 92 having a base 94, a first sidewall 96 extending upwardly from the base 94, a second sidewall 98 upwardly from the base 94 in a spaced relationship to the first sidewall 96, and a third sidewall 100 connected to the base 94, the first sidewall 96, and the second sidewall 98 and extending between the first sidewall 96 and the second sidewall 98. As shown, the first sidewall 96 and the second sidewall 98 may have an edge 102 extending in an arc between the third sidewall 100 and the base 94. It should be understood that the edge 102 of each of the first sidewall 96 and the second sidewall 98 may be shaped substantially as a curve, a portion of a square, a portion of a rectangle, a portion of a polygon, or any other suitable shape configured to engage a firearm proximate to a trigger guard to form one or more points of contact to secure the cover assembly 90 to the firearm.

Figure 6:
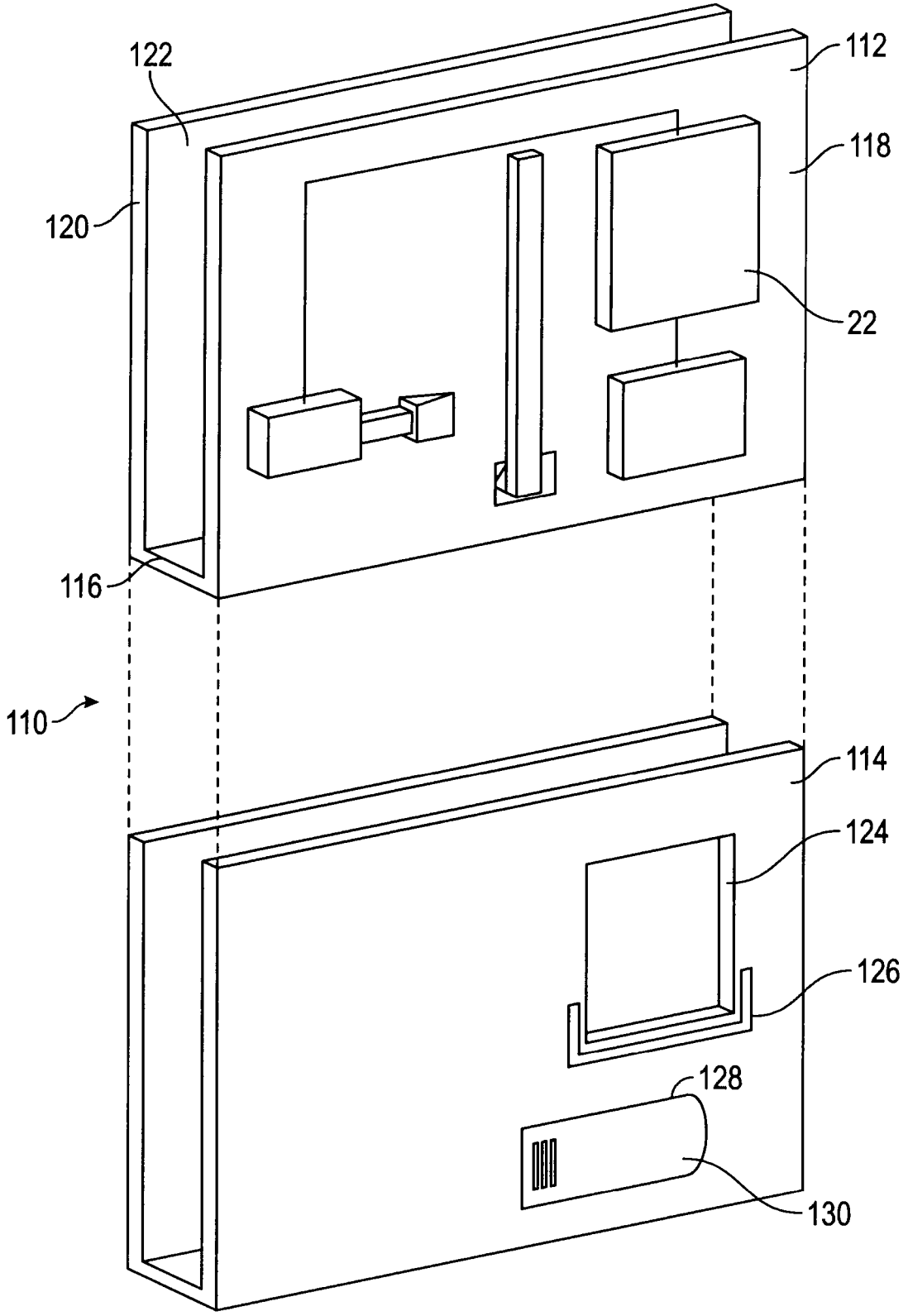
FIG. 6 is an exploded, perspective view of another embodiment of a cover assembly constructed in accordance with the inventive concepts disclosed herein.

Referring now to FIG. 6, another embodiment of a cover assembly 110 is illustrated. The cover assembly 110 may include an inner housing 112, the catch member 18 connected to the inner housing 112, the release assembly 20 mounted to the inner housing 112, the biometric sensor assembly 22 at least partially mounted to the inner housing 112, and an outer housing 114 configured to encompass the inner housing 112, the catch member 18, the release assembly 20, and at least a portion of the biometric sensor assembly 22. The inner housing 112 may be implemented similarly to the housing 16 with a base 116, a first sidewall 118 extending upwardly from the base 116, a second sidewall 120 extending upwardly from the base 116 in a spaced relationship to the first sidewall 118 so that the base 116, the first sidewall 118, and the second sidewall 120 cooperate to define a trigger guard receiving space 122. The catch member 18 may secure the inner housing 112 over the trigger guard 12, similarly to the catch member 18 securing the housing 16. Although shown in FIG. 6 as being implemented similarly to the housing 16, the inner housing 112 may be implemented similarly to the housing 72 or the housing 92.

The outer housing 114 may be connected to the inner housing 112 and may define an opening 124 for access to the biometric sensor assembly 22. The outer housing 114 may be provided with connections to the inner housing 112 such that the outer housing 114 may not be removed from the inner housing 112 while the inner housing 112 is covering the trigger guard 12. For example, the outer housing 114 may be connected to the inner housing 112 by mechanical connectors, such as one or more screws, bolts, or other mechanical connectors, which may be accessed through the trigger guard receiving space 122. As such, while the trigger guard 12 is within the trigger guard receiving space 122, the mechanical connectors may be blocked from access by the firearm 14 connected to the trigger guard 12. The outer housing 114 may be formed using methods and materials similar to that described for the housing 16. Although shown as corresponding to dimensions similar to that of the housing 16, the outer housing 114 may correspond to any dimensions of the inner housing 112, such as where the inner housing 112 is implemented similarly to the housing 72 or the housing 92, for example.

The outer housing 114 may define a ridge 126 proximate to the opening 124 and configured to enable removal of the inner housing 112 from the trigger guard 12 upon validation of the biometric input. The ridge 126 may be implemented similarly to the ridge 60.

In some embodiments, the opening 124 may be a first opening 124 and the outer housing 114 may include a second opening 128 configured to enable access to the power source connection 62. The second opening 128 may be sized and dimensioned to limit access to the power source connection 62, without enabling access to the inner housing 112 or a space extending between the inner housing 112 and the outer housing 114. In some embodiments, a cover 130 may be included with the outer housing 114 and sized and dimensioned to be secured to and/or to cover the second opening 128.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and as defined in the appended claims.

What is claimed is:

1. A cover assembly for a trigger guard, comprising:

a housing having a base, a first sidewall extending upwardly from the base, and a second sidewall extending upwardly from the base in a spaced relationship to the first sidewall so that the base, the first sidewall, and the second sidewall cooperate to define a trigger guard receiving space, at least the first sidewall having an opening extending therethrough;

a catch member extending from the first sidewall so as to be moveable between a locked position wherein at least a portion of the catch member extends through the opening of the first sidewall and into the trigger guard receiving space in a way to engage a trigger guard received in the trigger guard receiving space and thereby secure the housing over the trigger guard and an unlocked position wherein the catch member is retracted from the trigger guard receiving space to allow the housing to be removed from the trigger guard;

a release assembly mounted to the housing, the release assembly operable to cause the catch member to move from the locked position to the unlocked position; and a biometric sensor assembly at least partially mounted to the housing, the biometric sensor assembly configured to validate a biometric input and cause the release assembly to move the catch member from the locked position to the unlocked position based on validation of the biometric input, wherein the catch member has a retaining arm and a catch, the retaining arm is a flat spring and the catch extends outwardly from the retaining arm through the opening of the first sidewall and into the trigger guard receiving space.

2. The cover assembly of claim 1, wherein the housing further comprises a third sidewall connected to the base, the first sidewall, and the second sidewall and extending between the first and second sidewall.

3. The cover assembly of claim 1, wherein the biometric sensor assembly defines a ridge extending outwardly from the biometric sensor assembly and configured to enable removal of the housing from the trigger guard upon validation of the biometric input.

4. The cover assembly of claim 1, wherein the release assembly comprises an actuator and a wedge member connected to the actuator, the actuator configured to move the wedge member to contact the retaining arm, positioning the catch out of contact with the trigger guard.

5. The cover assembly of claim 1, wherein the housing is an inner housing and further comprising an outer housing configured to encompass the inner housing, the catch member, the release assembly, and at least a portion of the biometric sensor assembly.

6. The cover assembly of claim 5, wherein the outer housing defines an opening for access to the biometric sensor assembly.

7. The cover assembly of claim 6, wherein the outer housing defines a ridge proximate to the opening of the outer housing and configured to enable removal of the inner housing from the trigger guard upon validation of the biometric input.

8. The cover assembly of claim 6, further comprising a power source connection connected to the inner housing, wherein the opening of the outer housing is a first opening and the outer housing further defines a second opening configured to enable access to the power source connection.

9. A cover assembly for a trigger guard, comprising:

an inner housing having a base, a first sidewall extending upwardly from the base, and a second sidewall extending upwardly from the base in a spaced relationship to the first sidewall so that the base, the first sidewall, and the second sidewall cooperate to define a trigger guard receiving space, at least the first sidewall having an opening extending therethrough;

a catch member extending from the first sidewall so as to be moveable between a locked position wherein at least a portion of the catch member extends through the opening of the first sidewall and into the trigger guard receiving space in a way to engage a trigger guard received in the trigger guard receiving space and thereby secure the housing over the trigger guard and an unlocked position wherein the catch member is retracted from the trigger guard receiving space to allow the housing to be removed from the trigger guard;

a release assembly mounted to the inner housing, the release assembly operable to cause the catch member to move from the locked position to the unlocked position;

a biometric sensor assembly at least partially mounted to the inner housing, the biometric sensor assembly configured to validate a biometric input and cause the release assembly to move the catch member from the locked position to the unlocked position based on validation of the biometric input; and an outer housing configured to encompass the inner housing, the catch member, the release assembly, and at least a portion of the biometric sensor assembly, wherein the release assembly comprises an actuator and a wedge member connected to the actuator, the actuator configured to move the wedge member to contact the catch member, positioning the portion of the catch member extending into the opening out of contact with the trigger guard.

10. The cover assembly of claim 9, wherein the inner housing further comprises a third sidewall connected to the base, the first sidewall, and the second sidewall and extending between the first and second sidewall.

11. The cover assembly of claim 9, wherein the biometric sensor assembly defines a ridge extending outwardly from the biometric sensor assembly and configured to enable removal of the inner housing from the trigger guard upon validation of the biometric input.

12. The cover assembly of claim 9, wherein the outer housing defines an opening for access to the biometric sensor assembly.

13. The cover assembly of claim 12, wherein the outer housing defines a ridge proximate to the opening of the outer housing and configured to enable removal of the inner housing from the trigger guard upon validation of the biometric input.

14. The cover assembly of claim 12, further comprising a power source connection connected to the inner housing, and wherein the opening of the outer housing is a first opening and the outer housing further defines a second opening configured to enable access to the power source connection.

15. A cover assembly for a trigger guard, comprising:

an inner housing forming a rigid single member, the inner housing having a base, a first sidewall extending upwardly from the base, and a second sidewall extending upwardly from the base in a spaced relationship to the first sidewall so that the base, the first sidewall, and the second sidewall cooperate to define a trigger guard receiving space, at least the first sidewall having an opening extending therethrough;

a catch member having a retaining arm and a catch, the catch member extending from the first sidewall and moveable between a locked position wherein at least the catch extends through the opening of the first sidewall and into the trigger guard receiving space in a way to engage a trigger guard received in the trigger guard receiving space and thereby secure the inner housing over the trigger guard and an unlocked position wherein the catch is retracted from the trigger guard receiving space to allow the inner housing to be removed from the trigger guard;

a release assembly mounted to the inner housing, the release assembly operable to cause the catch member to move from the locked position to the unlocked position;

a biometric sensor assembly at least partially mounted to the inner housing, the biometric sensor assembly configured to validate a biometric input and cause the release assembly to move the catch member from the locked position to the unlocked position based on validation of the biometric input;

a power source connection, mounted to the inner housing and operatively connected to at least one of the release assembly and the biometric sensor assembly such that a power source connected to the power source connection provides power to the release assembly and the biometric sensor assembly; and an outer housing connected to the inner housing, the outer housing configured to encompass the inner housing, the catch member, the release assembly, and at least a portion of the biometric sensor assembly, the outer housing defining a first opening for access to the biometric sensor assembly and a second opening for access to the power source connection, wherein the release assembly comprises an actuator and a wedge member connected to the actuator, the actuator configured to move the wedge member to contact the catch member, positioning the portion of the catch member extending into the opening out of contact with the trigger guard.

16. The cover assembly of claim 15, wherein the inner housing further comprises a third sidewall connected to the base, the first sidewall, and the second sidewall and extending between the first and second sidewall.

17. The cover assembly of claim 15, wherein the biometric sensor assembly defines a ridge extending outwardly from the biometric sensor assembly and configured to enable removal of the inner housing from the trigger guard upon validation of the biometric input.

18. The cover assembly of claim 15, wherein the outer housing defines a ridge proximate to the first opening of the outer housing and configured to enable removal of the inner housing from the trigger guard upon validation of the biometric input.

* * * * *